US005816098A

United States Patent [19]

Kanki et al.

[11] Patent Number: 5,816,098

[45] Date of Patent: Oct. 6, 1998

[54] METHOD AND SYSTEM FOR CONTROLLING ATTITUDE OF LIFTING LOAD UTILIZING GYRO EFFECT

[75] Inventors: Hiroshi Kanki; Yoshitsugu Nekomoto, both of Hogyo; Tatsuya Wakisaka, Tokyo; Yasukuni Kamimura, Saitama; Atsuhiro Doyama, Tokyo; Shuji Oyagi, Nara; Kazunari Fukuda; Yuichi Ikeda, both of Kyoto; Fumihiro Inoue, Saitama; Koji Watanabe, Yamanashi, all of Japan

[73] Assignee: Mitsubishi Jukogyo Kabushiki Kaisha, Tokyo, Japan

[21] Appl. No.: 733,015

[22] Filed: Oct. 16, 1996

[30] Foreign Application Priority Data

Jun. 21, 1996 [JP] Japan ..... 8-162087
Jun. 24, 1996 [JP] Japan ..... 8-163160

[51] Int. Cl.[6] ..... B66C 13/08

[52] U.S. Cl. ..... 74/5.22; 74/5.9

[58] Field of Search ..... 74/5.22, 5.44, 74/5.9, 5.43; 414/754; 294/81.4; 212/273

[56] References Cited

U.S. PATENT DOCUMENTS 2,961,877 11/1960 Edwards ..... 74/5.22
3,210,114 10/1965 Lawton ..... 414/754 X
3,498,476 3/1970 Mattson et al. ..... 294/81.4 X
3,608,384 9/1971 Hardin ..... 74/5.22
5,632,222 5/1997 Fido ..... 74/5.22 X

*Primary Examiner*—Rodney H. Bonck
*Attorney, Agent, or Firm*—Wenderoth, Lind & Ponack, L.L.P.

[57] ABSTRACT

A lifting load attitude controlling system includes a lifting load pivoting clutch (20) provided between a gyro frame (1) and a gimbal frame (6) for connecting and disconnecting therebetween. Also, a resetting rotating clutch is provided between a resetting rotation driving portion constituted of a resetting oblique rotation driving motor (19) for rotating a gimbal (8) upon returning the gimbal (8) at an initial position and a worm gear, and the gimbal (8) for connecting and disconnecting therebetween. Upon obliquely rotating the gimbal for returning to the initial position, the resetting rotating clutch is placed in the engaged or connected state and the lifting load pivoting clutch is placed in the disengaged or disconnected state. When the resetting rotation driving motor (19) is driven at this condition, a gyro moment is generated upon obliquely driving the gimbal toward the gyro frame (1) (lifting jig 4) via a variable constant torque motor (19) between the gyro frame (1) and a gimbal frame (6). However, since the gyro moment is much smaller than the inertia moment of the lifted load, it provides little influence relative to pivoting motion of the load.

18 Claims, 8 Drawing Sheets

——— CONVENTIONAL METHOD
------- METHOD ACCORDING TO THE INVENTION

METHOD AND SYSTEM FOR CONTROLLING ATTITUDE OF LIFTING LOAD UTILIZING GYRO EFFECT

BACKGROUND OF THE INVENTION

1. Field of the Invention

The present invention relates to a method and a system for controlling attitude of a lifting load for appropriately pivoting a lifting load lifted by means of a wire rope or so forth. More specifically the invention relates to a system which carries a gyro on a lifting jig for lifting the lifting load in horizontal attitude by means of the wire rope or so forth and obtaining a horizontal rotating force of the lifting jig in the horizontal direction utilizing a gyro effect.

2. Description of the Related Art

Conventionally, there are proposals for a crane with a rigid arm or rotary apparatus utilizing torsion of a rope as a reacting force, for automating a pivoting operation of a lifting load in a cargo operation. The former apparatus is excessively large in weight in relation to a lifting performance. The latter apparatus is unstable in pivoting behavior of lifting load. In place of these apparatuses, there has been proposed a rotating attitude control system utilizing gyro effect (for example, Japanese Examined Patent Publication (Kokoku) No. Heisei 4-17873).

The rotating attitude controlling system for the lifting load disclosed in the above-identified publication is formed with a lifting jig which is hanged in horizontal attitude on a wire rope and mounting a lifting load at the lower portion thereof, a frame fixed on the lifting jig, and a case rotatable about a rotation axis parallel to an extending direction relative to the frame, and a flywheel capable of spinning on a shaft perpendicular to a surface including a rotation axis of the case. The case and the flywheel form a gimbal structure to form a pseudo gyroscope together with the frame. Then, by detecting an angle of natural pivoting motion of the lifting load by external disturbance, such as wind and so forth, the lifting load is pivoted in the opposite direction in a magnitude corresponding to the natural rotation by driving the gimbal by a motor, while the natural rotation angle is relatively small, for constantly maintaining a predetermined azimuth angle.

On the other hand, in such rotating attitude controlling system of the lifting load utilizing the gyro effect, rotational position of the gimbal in repeated use of the system cannot be constant. Also, when external disturbance, such as wind or so forth, is exerted on the lifting load (lifting jig), the gimbal is rotated depending upon the magnitude of the external disturbance so as to restrict rotation due to the external disturbance. The gimbal may be oriented to dislocate the offset position to tilt due to rotation, namely a spinning shaft of the flywheel is angled from the horizontal direction. Here, the offset position is the rotational position of the gimbal when the driving motor of the gimbal is not actuated and the gimbal is not locked.

Subsequently, when the gimbal is rotated to an initial position (hereinafter simply referred to as "initial position") to orient the spinning shaft horizontally, rotation in the direction of the external disturbance is accelerated. On the other hand, in control at this time, when driving of the motor for rotating the gimbal is terminated, a component of accelerating rotation can be canceled by rotating the gimbal. Therefore, it is not possible to return the gimbal to the initial position simply by rotating the gimbal in the opposite direction. It requires substantial skill to return the gimbal acting as set forth above, from the rotated position to the initial position. Furthermore, since the operator is often away from the system, resetting the operation by the operator alone is difficult.

On the other hand, upon initiation of actuation of gimbal by forcefully rotating in either direction to rotate the lifting load in the condition where the attitude maintaining the spinning axis of the flywheel in a non-horizontal orientation, the gyro effect may be canceled to effect a rotational force about the vertical axis.

On the other hand, when the spinning axis (rotational angle of the gimbal) of the flywheel, operated to rotate in one direction, is horizontally oriented (0°), the horizontal rotating force by the gyro effect becomes a maximum. When the orientation of the spinning axis approaches the vertical direction (the condition where the flywheel is oriented horizontally) beyond a given angle, the horizontal rotating force is gradually reduced. When the spinning axis is oriented vertically, the horizontal rotating force becomes zero. Therefore, in the system for controlling rotational attitude of the lifting load utilizing such gyro effect, it becomes necessary to preliminarily design so as to establish an equilibrium between an input torque and a reacting torque so that the rotational angle of the gimbal can be maintained within the given angular range when the lifting load with allowable maximum load, on the basis of the relationship between the allowable maximum load of the lifting load and the input torque. However, if the rotating operation is performed in the condition where the actual rotational load of the lifting load exceeds the allowable maximum load, the rotational angle of the gimbal may approach the vertical direction across the given angle to make the horizontal rotating force smaller so as to lower the rotation speed and to finally reduce the horizontal rotating force zero.

Furthermore, in practice, during slinging work, inslinging work, placement operation and so forth, it becomes necessary to eliminate the gyro effect so that the operator may freely rotate the lifting load for fine adjustment. Also, at the occurrence of the possibility of a collision of the lifting load and a building during rotation control, it becomes necessary to abruptly stop pivotal motion of the lifting load to avoid the collision. However, in order to abruptly stop the pivotal motion of the lifting load, it becomes necessary to abruptly stop the flywheel, which has a large mass weight rotating at a high speed, or to drive the flywheel to spin in the opposite direction in order to abruptly increase the rotation speed. This results in complicated and large size construction of the system (brake system and/or spinning motor system). Furthermore, inertia energy loss in the flywheel becomes so significant that it makes the system inefficient. Furthermore, it becomes difficult to perform a sequence of operations such as high speed spinning in the forward direction, stopping of spinning and then high speed spinning in the reverse direction at sufficiently high speeds.

SUMMARY OF THE INVENTION

The present invention has been developed to address the problems in the prior art. Therefore, it is a first object of the present invention to provide a method and system for controlling a lifting load which can easily return a gimbal, which is rotated by an external disturbance, to an initial position without influencing pivotal motion of the lifting load by cancelling a gyro effect.

A second object of the present invention is to make it possible to stop pivotal motion of the lifting load while maintaining spinning of a flywheel in one direction without stopping the spinning.

A third object of the present invention is to make it possible to obtain a horizontal rotating force even when a rotational load of the lifting load exceeds a designed allowable maximum load.

A fourth object of the present invention is to improve a rotating force upon forcefully driving the lifting load to rotate by forcefully driving the gimbal for rotation after once stopping driving of the gimbal in the condition where a spinning axis is not in a horizontal orientation.

In order to accomplish the above-mentioned objects, according to the first aspect of the invention, a lifting load attitude control system utilizing a gyro effect, comprises:

a lifting jig to be suspended in a horizontal attitude for hanging a lifting load;

a gyro frame fixed to the lifting jig;

gimbal supported by a horizontal rotation shaft on said gyro frame;

a flywheel capable of spinning about a spinning shaft perpendicular to a surface including the rotation shaft with respect to the gimbal;

a rotational driving portion mounted on the gimbal frame and driving the gimbal in forward and reverse directions;

a spinning driving portion mounted on the gimbal for spinning the flywheel;

a lifting load pivoting clutch for making the gyro frame and the gimbal frame releasable; and a mechanism for canceling a reaction torque to be exerted on the rotational driving portion from the gimbal frame.

In the construction set forth above, under a normal rotating operation, the lifting load pivoting clutch is placed in an engaged or a connected position. By driving the spinning driving portion and the rotational driving portion at this condition, rotation and stopping of pivoting motion of the load is performed.

When an external disturbance, such as wind or so forth is exerted on the load for causing pivoting motion about the pivoting axis, the gimbal is rotated to place the spinning shaft of the flywheel at an orientation close to vertical depending upon the magnitude of the externally applied disturbing force. Thereafter, when the gimbal is returned to the initial position, the lifting load pivoting clutch is placed in a disengaged condition and the rotational driving portion is driven in a reverse direction. Then, the gimbal rotates obliquely. At this time, since the flywheel is held rotating, a gyro effect is caused to effect rotation of the gimbal frame in the same direction. However, since the gimbal frame and the gyro frame (lifting jig) are spaced away from each other, the gimbal may solely rotate without influencing the gyro frame. Accordingly, the gimbal may be returned to the initial position without exerting a pivoting force to the load in the same direction.

It should be noted that when the switch of the rotational driving portion is turned OFF when the gimbal frame returns to the initial position, an inertia force is exerted on the gimbal frame for further rotation to cause an opposite gyro effect to act as a force (torque) to obliquely rotate the gimbal in the direction away from the initial position on the rotational driving portion. However, since the mechanism for canceling the reaction torque is provided, the gimbal can be maintained at the initial position.

According to the second aspect of the invention, the lifting load attitude control system may further comprise:

a resetting oblique rotation driving portion for obliquely rotating the gimbal upon returning the gimbal at initial position;

a worm gear mechanism connected to the resetting oblique rotation driving portion;

a resetting obliquely rotating clutch provided between the worm gear mechanism and the gimbal or the rotational driving portion and making them releasable; and control means for controlling pivoting motion of the lifting load hanged on the lifting jig by controlling driving of the spinning driving portion, the rotational driving portion, and engagement and disengagement of the lifting load pivoting clutch and the resetting obliquely rotating clutch.

In the normal rotating operation, in addition to maintaining of the lifting load pivoting clutch in the engaged condition, the resetting obliquely rotating clutch is placed in the disengaged position. Upon oblique rotation for returning the gimbal to the initial position, the resetting obliquely rotating clutch is placed in the engaged position and the lifting load pivoting clutch is placed in the disengaged position. When the resetting oblique rotation driving portion is driven at this position, similarly to the first aspect of the invention, the gimbal may be rotated without exerting a pivoting force on the lifted load.

According to the third aspect of the invention, the lifting load attitude control system may further comprise a variable constant torque transmitting device provided between the gyro frame and the gimbal frame.

Upon obliquely rotating the gimbal to return to the initial position, the gimbal frame is rotated by gyro effect. Then, only a relatively small torque set by the variable constant torque transmission device is transmitted to the gyro frame. The gimbal can be quickly returned to the initial position with little influence on the gyro frame and thus the lifting jig (lifted load). At this time, as a reaction field of the inertia moment of the lifting load, a small transmission torque between the gyro frame and the gimbal frame serves as a force for braking rotation of the gimbal frame.

According to the fourth aspect of the invention, a method for controlling pivoting motion of a load suspended by a lifting jig employing a lifting load attitude control system as set forth above, comprises the steps of:

placing the lifting load pivoting clutch in an engaged condition, placing the resetting obliquely rotating clutch in a disengaged condition and driving the spinning driving portion and the rotational driving portion during normal rotating operation; and placing the resetting obliquely rotating clutch in an engaged condition, placing the lifting load pivoting clutch in a disengaged condition and driving the resetting oblique rotation driving portion upon returning the gimbal to the initial position.

According to the fifth aspect of the invention, a lifting load attitude control system utilizing a gyro effect, comprises:

a lifting jig to be suspended in a horizontal attitude for suspending a load;

a gyro frame fixed to the lifting jig;

gimbal supported by a horizontal rotation shaft on said gyro frame;

a flywheel capable of spinning about a spinning shaft perpendicular to a surface including the rotation axis with respect to the gimbal;

a rotational driving portion mounted on the gimbal frame and driving the gimbal in a forward and a reverse direction;

a spinning driving portion mounted on the gimbal and spinning the flywheel;

a rotational position detecting sensor for detecting a rotational position of the gimbal;

the rotational driving portion controlling rotation of the gimbal from the rotational position toward initial position on the basis of the output of the rotational position detecting sensor; and braking means for stopping the rotational driving portion when the rotational position of the gimbal substantially coincides with the initial position.

With such a system, on the basis of the rotational position signal from the rotational position detecting sensor, a sequence of controls for resetting the gimbal at the initial position by controlling rotation of the gimbal, experience and qualification are not required to reset the gimbal in operation by one operator.

According to the sixth aspect of the invention, a method for controlling resetting of a gimbal employing a lifting load attitude control system utilizing a gyro effect as set forth above, comprises the steps of:

fixing the lifting jig or the lifting load on a stationary portion to prohibit them from rotating irrespective of forced rotation of the gimbal;

subsequently rotating the gimbal by the rotational driving portion for returning to the initial position.

In this method, when the lifting load is lifted under the condition where the flywheel is driven for spinning in the predetermined direction at high speeds to forcedly vary the attitude of the lifting load, the gimbal is forcedly rotated by the rotational driving portion to create a gyro effect to rotate the lifting jig (lifted load) in the direction not being obstructed by the weight component of the load.

On the other hand, in order to stop rotation as forcedly rotated, the power supply for the driving motor may be shut off to cause the pivoting inertia moment of the lifting load to be exerted on the gimbal to generate the gyro moment by the gyro effect for obstructing pivoting motion of the lifting load which will stop rotation.

When the system is subjected to an external disturbance, such as wind causing rotation of the gimbal to shift an offset position, or in the alternative when the gimbal is to be placed at the initial position, the lifting jig or the load is placed at a fixed portion, such as the construction, ground or so forth, or fixed by other means so as to prevent pivoting irrespective of rotation of the gimbal. Thereafter, on the basis of the rotational position of the gimbal detected by the rotational position detecting sensor, the gimbal is rotated in the direction requiring a smaller rotational magnitude to reach the initial position. Upon detection of reaching a position close to the initial position, the gimbal is locked. By this, the gimbal may be reset at the initial position with releasing the gyro effect, and thus a lifting operation for the load requiring pivoting of the load can be continuously performed.

According to the seventh aspect of the invention, a lifting load attitude control system utilizing a gyro effect, comprising:

a lifting jig disposed in a horizontal attitude for suspending a lifting load;

a gyro frame fixed to a lifting jig;

a gimbal frame rotatable about a rotation axis perpendicular to the gyro frame;

a gimbal rotatable about a rotation axis perpendicular to a surface including the rotation axis of the gimbal frame, relative to the gimbal frame;

a flywheel capable of spinning about a spinning shaft perpendicular to the surface including the rotation axis;

a rotational driving portion for rotating the gimbal mounted on the gimbal frame in the forward and reverse directions;

a spinning driving portion for spinning the flywheel mounted on the gimbal;

a rotational position detecting sensor for detecting a rotational position of the gimbal;

air ejecting means for generating a moment about a rotation shaft on the lifting jig for rotating the jig from the rotational position of the gimbal to an initial position by air ejection on the basis of the output of the rotational position detecting sensor; and braking means for stopping the rotational driving portion when the rotational position of the gimbal substantially coincides with the initial position.

With this system, the air ejection means creates a moment about the pivot axis on the lifting jig to rotate toward the reset position from the rotating position of the gimbal by a reaction associated with ejection air. Therefore, without requiring highly qualified skill, the gimbal can be easily returned to the reset position during aerial hanging of the load without causing pivoting of the load. Also, it is possible to slightly move the lifting load in a parallel direction without causing a rocking motion of a lifting machine by the air ejecting means.

According to the eighth aspect of the invention, the air ejecting means ejects air in a pulse form. With this system, quick reset can be performed without actuating the braking device. Also, since air ejection is performed by opening and closing of a electromagnetic valve provided in the vicinity of the nozzle, influence of pressure loss in the intermediate path supplying the air can be reduced so as to permit high pressure and high speed air ejection.

According to the ninth aspect of the present invention, a free rotation direction controller is provided on the rotation shaft of the gimbal. With this device, even when a lifted load is pivoted with a single harmonic motion, resetting can be accomplished by permitting rotation in only the resetting direction.

According to the tenth aspect of the present invention, the rotation shaft of the gimbal is located at the upper side or above a gravity center of the gimbal including the flywheel. With this invention, the rotation shaft of the gimbal is located above the gravity center of the gimbal including the flywheel (the spinning axis: when the gravity center of the gimbal and the spinning axis are consistent). On the other hand, when the gimbal is rotated upon receiving an external disturbance, the gravity center of the gimbal is located at a lower side of the rotation shaft, and horizontal attitude of the spinning axis can be returned by own weight. Therefore, when the lifting load is pivoted by forced rotation of the gimbal in the next occasion, rotational force about the vertical axis, namely rotating force can be improved.

According to the eleventh aspect of the invention, a stopper is provided for restricting rotation of the gimbal by permitting only rotation within a predetermined angular range of the spinning axis of the fly wheel from a horizontal axis in a vertical plane taking the rotation shaft as a zero coordinate. With this invention, the rotation shaft of the gimbal (spinning axis of the flywheel) may not approach the vertical direction exceeding the predetermined angle. Therefore, sufficient gyro effect can be constantly obtained. When a load which exceeds the predetermined allowable maximum load, is pivoted, the gimbal tends to cause rotation exceeding the predetermined angle. The rotation range of the gimbal is restricted by the stopper. Thus, the gimbal contacts the stopper to instantly make the gyro effect ineffective. However, since the load is already pivoted, pivoting is continued due to inertia. Therefore, even the overloaded load may be pivoted. Accordingly, the operation for forcedly rotating the gimbal, contacting the gimbal to the stopper, cutting off the rotational driving force of the gimbal, is repeated to continuously pivot the lifted load with excessive load.

According to the twelfth aspect of the invention, the predetermined angle is an angle of the gimbal when equilibrium between the input torque by a rotation motor rotating the gimbal and a reaction torque generated in the rotation shaft of the gimbal frame upon pivoting of the load with a designed allowable maximum load at a steady pivoting speed or an angle slightly greater than the angle of the gimbal. With this invention, the rotation range of the gimbal can be restricted in the range to be effectively used.

According to the thirteenth aspect of the invention, the rotation shaft of the gimbal is set at a position lower than a gravity center of the gimbal including the flywheel. With this invention, even when the rotation shaft of the gimbal is located below the spinning axis of the flywheel, a similar effect can be obtained as was obtained by the action of the stopper.

According to the fourteenth aspect of the invention, employing the system including a braking portion for effecting braking of rotation of the gimbal and control means for pivoting lifted load suspended by the lifting jig by controlling driving of the rotation driving portion, spinning driving portion and the braking portion; the method comprises the step of stopping rotation of the gimbal by the braking portion or locking the gimbal during high speed rotation of the flywheel by driving of the spinning driving portion. With this method, with a simple construction, in which the braking portion for braking rotation of the gimbal is additionally provided, upon placement of the load at the predetermined position by manually handling the load, by locking rotation of the gimbal in the condition where the gimbal may rotate freely, the gyro effect can be released so that the pivoting stopping force may not act on the lifting load to enable abrupt stopping of rotation to permit subsequent free pivotal motion and pivot stopping motion by manual operation. On the other hand, when the gimbal is placed for free rotation in the condition where the gimbal is rotated forcedly, pivotal motion of the load by inertia and external disturbance can be gradually decelerated until stopped. Therefore, free pivotal motion and pivot stopping motion by manual operation for final adjustment becomes possible.

According to the fifteenth aspect of the invention, pivoting of lifting load due to inertia of the lifted load and external disturbance can be stopped by making the gimbal free during high speed rotation of the flywheel by driving of the spinning driving portion. With the present invention, when the gimbal is free to rotate in the condition where the gimbal is forcedly rotated for pivoting the lifting load, the inertia force of the flywheel resisting the pivoting of the lifting load which continues pivotal motion by inertia, is exerted to gradually stop pivotal motion of the lifted load. At this time, the gimbal is rotated in the reverse direction by the restoring force to cancel mechanical loss of the speed reduction gear unit. The rotation motion mechanism and the braking device form the rotation driving portion of the gimbal.

BRIEF DESCRIPTION OF THE DRAWINGS

The present invention will be understood more fully from the detailed description provided herebelow and from the accompanying drawings of the preferred embodiment of the invention, which, however, should not be taken as limiting to the present invention, but are presented for explanation and understanding only.

In the drawings.

DESCRIPTION OF THE PREFERRED EMBODIMENT

The present invention will be discussed in detail in terms of the preferred embodiment, with reference to the accompanying drawings. In the following description, numerous specific details are set forth in order to provide a thorough understanding of the present invention. It will be obvious, however, to those skilled in the art that the present invention may be practiced without these specific details. In other instances, wellknown structures are not shown in detail in order to avoid unnecessarily obscuring the present invention.

Figure 1:
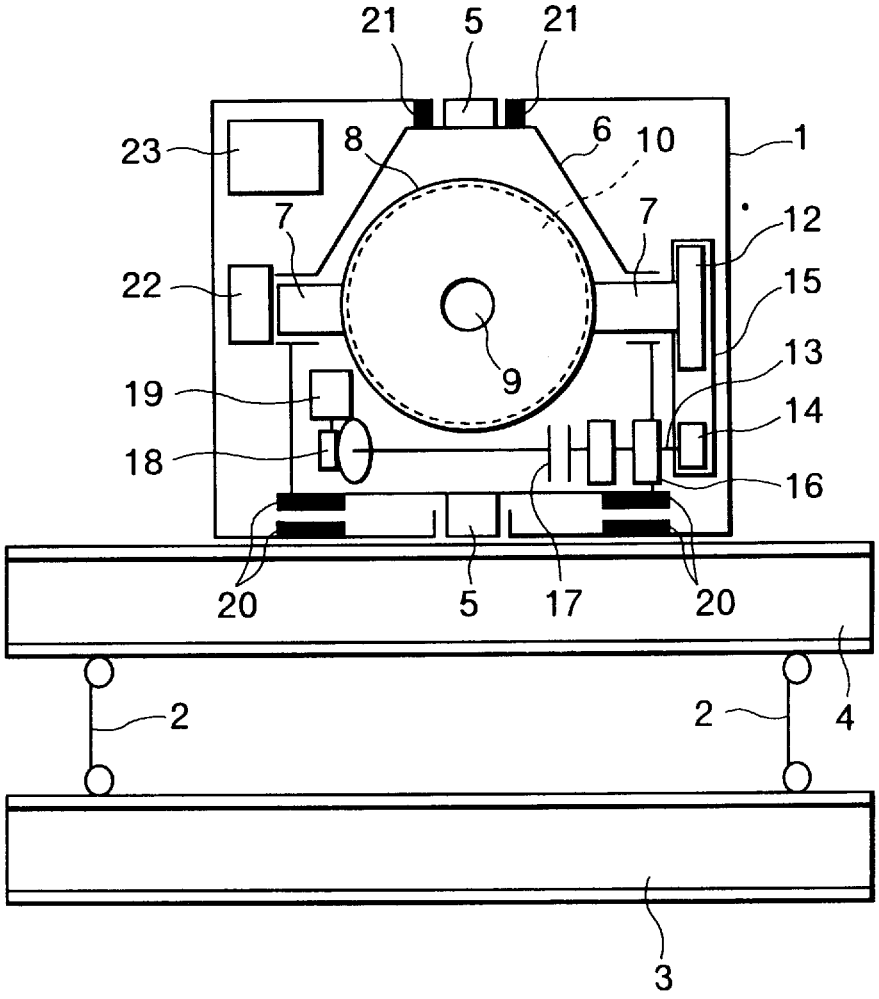
FIG. 1 is a front elevation showing an overall construction of one embodiment of a lifting load attitude controlling system utilizing a gyro effect, according to the present invention.

FIGS. 1 and 2 show a lifting load attitude controlling system utilizing a gyro effect according to the present invention. The shown lifting load attitude controlling system includes a box shaped gyro frame 1 hanged by a crane (not shown), a lifting jig 4 formed with a wide flange beam or H steel for suspending a lifting load 3 (wide flange beam in the shown case) with hanging ropes 2, 2. The lifting jig is fixedly integrated in a horizontal condition on the bottom portion of the gyro frame 1. A gimbal frame 6 is rotatable about a vertical rotation axis 5 within the gyro frame 1, and a gimbal 8 is rotatable about a rotation shaft 7 with respect to the gimbal frame 6. Also, provided is a flywheel 10 which can spin about a spinning shaft 9 with respect to the gimbal 8.

The gimbal 8 is rotatable at an appropriate speed in both the forward and reverse directions about a rotation shaft 7 (axis parallel to the lifting jig 4), which is perpendicular to a surface including a rotation axis 5 of the gimbal frame 6. The gimbal is rotated by means of a gimbal driving motor 11 (rotary driving portion) which is mounted on the gimbal frame 6. On the other hand, the flywheel 10 can spin at high speeds about the spinning shaft 9 which is perpendicular to a surface including the rotation shaft 7 of the gimbal 8 by a not shown spinning motor (spin driving portion) mounted on the gimbal. The gimbal driving motor 11 and the spinning motor are electromagnetic motors for driving rotation and spinning of the rotation shaft 7 and the spinning shaft 9 in a non-contact state, respectively. Accordingly, by shutting off the power supply for the motor 11, the rotation shaft 7 can be rotated freely. It should be noted that it is possible to employ a normal stepping motor or so forth instead of employing the electromagnetic motor, as the gimbal driving motor 11.

Further concrete discussion will be provided for the rotation mechanism of the gimbal 8. Namely, a driven pulley 12 is connected to one end of the rotation shaft 7 of the gimbal 8. A driving pulley 14 is connected to one end of a rotary driving shaft 13 which is arranged in parallel to the rotation shaft 7. A timing belt 15 is wound around both pulleys 12 and 14. At an intermediate portion of the rotary driving shaft 13, a rotational driving force of the gimbal driving motor 11 is transmitted to the rotary driving shaft 13 via a helical gear box 16 (speed reduction gear unit).

Furthermore, the other end of the rotary driving shaft 13 is releasably connected to a resetting obliquely rotating motor 19 (resetting obliquely rotating driving portion) via a resetting obliquely rotating clutch 17 (electromagnetic clutch) and a speed reduction mechanism 18. The gimbal driving motor 11 can rotatingly drive the rotary driving shaft 13 in forward and reverse directions in a non-contact condition. A worm gear mechanism 18 has non-reversible characteristics for permitting transmission of a driving force from the resetting obliquely rotating motor 19 to the rotary driving shaft 13 but prohibiting transmission of driving force from the rotary driving shaft 13 to the resetting oblique rotating motor 19.

The resetting obliquely rotating clutch 17 is placed in a released condition, the rotational driving force of the gimbal driving motor 11 is transmitted to the rotating driving shaft 13 and then transmitted to the rotation shaft 7 of the gimbal 8 via the driving pulley 14, the timing belt 15 and the driven pulley 12 in order. On the other hand, when the resetting obliquely rotating clutch 17 is placed in an engaged condition, an obliquely rotating driving force of the resetting obliquely rotating motor 19 is transmitted to the rotary driving shaft 13 and then transmitted to the rotation shaft 7 of the gimbal 8. Accordingly, the gimbal driving motor 11 drives the gimbal 8 in forward and reverse directions, whereas the resetting obliquely rotating motor 19 is adapted to drive the gimbal obliquely upon returning to the initial position.

It should be noted that the resetting obliquely rotating clutch may be directly connected to the gimbal via the driven pulley 12 instead of being connected to the resetting obliquely rotating motor 19.

Also, between the bottom surface of the gyro frame 1 and the upper surface of the bottom portion of the gimbal frame 6, a lifting load pivoting clutch 20 is provided for contacting and releasing the surfaces. When the lifting load pivoting clutch 20 is placed in a connecting condition, the gimbal frame 6 rotates integrally with the gyro frame 1, namely the lifting jig 4 (lifting load 3). On the other hand, when the lifting load pivoting clutch 20 is released, even when rotation of the gimbal 8 is transmitted to the gimbal frame 6, the transmitted rotation force will not influence the lifting jig 4 (lifting load).

Between the lower surface of a ceiling portion of the gyro frame 1 and the upper surface of the ceiling portion of the gimbal frame 6, a variable constant torque transmitting device 21 is provided. The variable constant torque transmitting device 21 is adapted to transmit only torque preliminarily set to be smaller among rotating forces of the gimbal frame 6.

The gimbal frame 6, the gimbal 8, the flywheel 10 and so forth form a gyro. It should be noted that, an oblique rotation detector 22, for detecting an obliquely rotating condition of the gimbal, is provided at the position of the other end of the rotation shaft 7 of the gimbal. Within the gyro frame 1, a control unit 23 and so forth control the gyro, the oblique rotation detector 22 and so forth control rotational driving of the gimbal driving motor 11, the spinning motor and the resetting obliquely rotating motor 19, and control rotational driving of the resetting oblique rotation clutch 17, the lifting load pivoting clutch 20 for contacting and releasing.

It should be noted that, a rotation controlling controller for controlling rotational driving of the gimbal driving motor 11 and the spinning motor, a radio antenna for remote control of the controller, a power source battery and a charge therefor may be provided with the gyro frame 1, in addition to the gyro as set forth above. The operator carries a portable radio transmitter receiver for ratio remote control with a radio transmitter receiver in the gyro frame 1 and performs ratio remote control of the controller while visually observing the attitude of the lifting load. Here, the ratio transmitter receiver to be operated by the operator can be not portable. Also, the radio remote control can be performed at either the feeding side or receiving side or both sides with setting a preferential order of operation. Furthermore, it is possible to externally supply the necessary power.

Next, operation of the load attitude control system will be discussed.

Upon normal rotating operation, the lifting load pivoting clutch 20 is placed in the connected or engaged condition and the resetting obliquely rotating clutch 17 is placed in the disconnected or released condition. In this condition, the spinning driving motor and the gimbal driving motor 11 are driven to rotatingly drive the gimbal for generating a gyro effect in order to cause rotation of the load 3 via the gimbal frame 6, the gyro frame 1 and the lifting jig 4. On the other hand, when rotational driving of the gimbal 8 is stopped, the gimbal 8 is driven so as to rotate by rotational force of the load 3. By the gyro effect thus generated, the pivoting force of the load 3 can be canceled so as to stop the pivotal motion of the load 3.

When external disturbances, such as wind and so forth are exerted on the load 3, the gimbal 8 is rotated to orient spinning shaft 9 of the flywheel 10 at an angle close to vertical depending upon the force of the external disturbance. Subsequently, upon obliquely driving the gimbal to return to the initial position, the resetting obliquely rotating clutch 17 is placed in the connected condition and the lifting load pivoting clutch 20 is placed in released condition. In this condition, when the resetting obliquely rotating motor 19 is driven, the gimbal 8 is obliquely rotated via the worm gear mechanism 18 and the rotary driving shaft 13. When the gimbal frame 6 is driven so as to obliquely rotate in the resetting direction, the gimbal frame 6 is rotated in the same direction to the external disturbance by the gyro effect. At this time, since the gyro frame 1 (lifting jig 4) and the gimbal frame 6 are placed in a released condition, the rotational force of the gimbal 6 by gyro effect is not transmitted to the gyro frame 1. Accordingly, the rotational force is not transmitted to the lifting jig 4.

It should be noted that the resetting obliquely rotating motor 19 is connected to the worm gear mechanism 18 having non-reversible characteristics, and thus an anti-gyro moment due to the inertia moment of the gimbal frame 6 can be dumped. Accordingly, by applying a large torque at low rotation speed for the gimbal, the gimbal frame 6 is rotated by the gyro moment. The rotational force to be transmitted to the gyro frame 1 acts on the variable constant torque transmitting device 21 so as to be converted to only a smaller rotational torque. Thus, the transmitted rotation force may have little influence on the gyro frame 1.

Furthermore, if acceleration and deceleration control, such as speed control for accelerating zone, constant speed zone and decelerating zone or so forth, is performed by obliquely rotating the gimbal frame 6, operations of the variable constant torque transmission device 21 and the worm gear mechanism 18 may be caused depending upon oblique rotational speed and toque of the gimbal and pivoting speed of the gimbal frame 6, in chained manner so as to position the gimbal at a predetermined position without significantly influencing pivoting motion of the load 3, and to control braking of the gimbal frame 6.

While the foregoing discussion has been given for the case where the dedicated resetting obliquely rotating motor 19 is employed, it should be possible to reset the gimbal driving motor 11 without employing the dedicated motor.

Figure 2A:
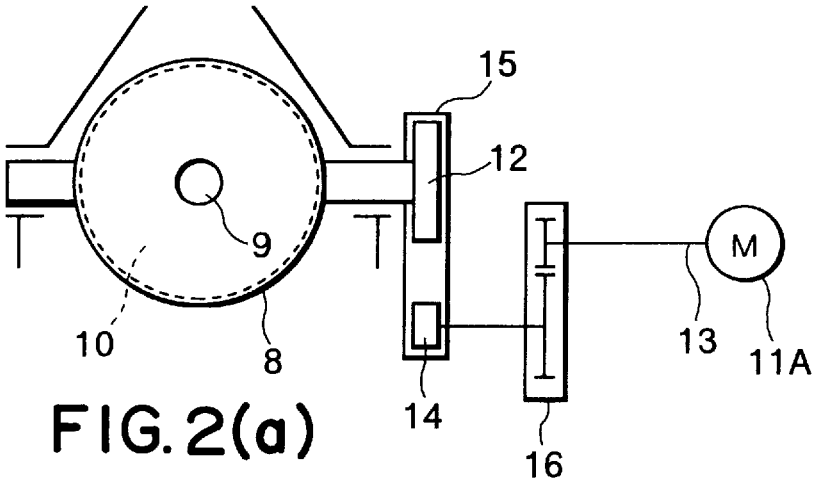
FIGS. 2(*a*)–2(*c*) are explanatory illustrations showing a mechanism for canceling a reaction torque.
Figure 2B:
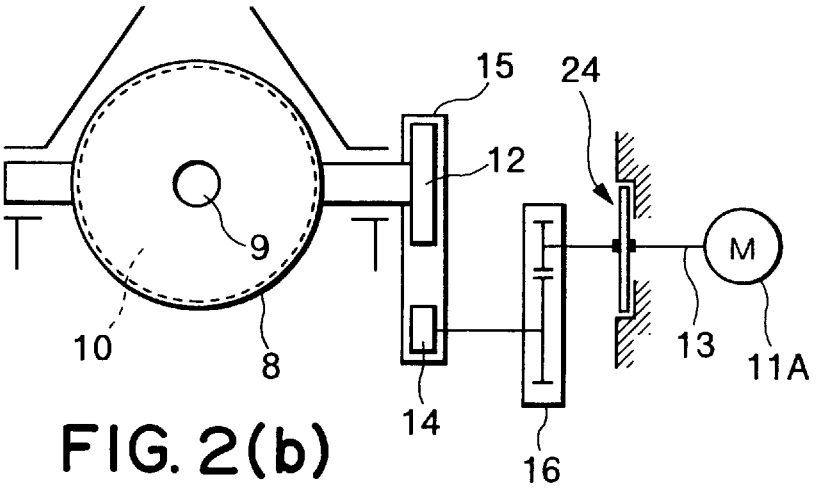
Figure 2C:
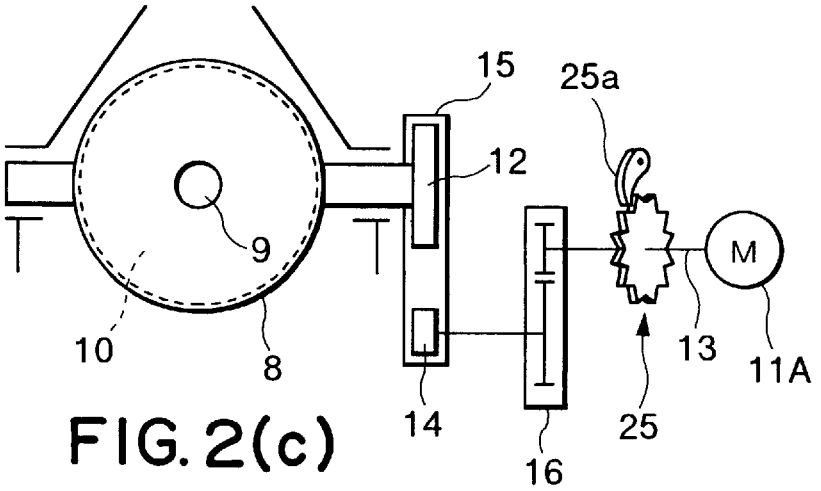

In such a case, it becomes necessary to provide mechanism for canceling the reaction torque, as set forth above. In such a mechanism, (1) the gimbal driving motor 11 is constructed with a motor 11A having a brake (FIG. 2*a*);

(2) an electromagnetic brake 24 is provided on a transmission shaft between the gimbal driving motor 11 (rotatingly driving portion) and the gimbal (FIG. 2*b*); or (3) a ratchet mechanism is provided on the transmission shaft between the gimbal driving motor 11 and the gimbal for selective engagement of a claw of the rachet (FIG. 2*c*).

When the gimbal driving motor 11 is constructed with a motor having a brake or an electromagnetic brake is provided in a transmission shaft connected to the gimbal 8, the following operation is performed.

(1) Placement to Predetermined Position while Maintaining Attitude of Lifting Load (1) Lifting Up The rotation shaft 7 of the gimbal 8 is made to freely rotate. In this condition, when a rotational force is exerted on the lifting load due to an external disturbance, the resulting rotational force is transmitted to the flywheel 10 via the lifting jig 4 and the gimbal 8. As a result, by gyro effect of the flywheel 10, the gimbal 8 is rotated. By a reaction of inertia of the flywheel caused at this time, a resisting force against rotation of the load 18 acts to restrict rotation of the load so as to maintain the lifting attitude before exertion of the external disturbance.

(2) Placement

When the load 3 reaches a predetermined position and is capable of being handled such as by a crane, forcedly stopping the load 3 manually is similar to stopping rotation by exerting a rotation stopping force. Furthermore, in order to make the rotation stopping force inactive upon fine adjustment of the placement position by forcedly rotating the load manually, the rotation shaft 7 is braked by the brake of the gimbal driving motor 11 for locking. Then, the gyro effect is released so as not to apply the rotation stopping force in order to permit free operation of the load. Thus, the rotating and rotation stopping operation can be done freely. In this case, since rotation of the load is stopped upon gripping of the lifting load manually, rotation of the lifting load due to the inertia force can be abruptly stopped without continuing rotation.

(2) Placement in a Predetermined Position by Positively Varying Attitude of Load (1) Lifting Up When the flywheel is driven for high speed spinning, the gimbal 8 is forcedly rotated in a desired direction at a desired speed by the gimbal rotating motor 11, the rotating force is generated about a vertical axis due to the gyro effect of the gyro. By this pivoting force, the load 3 can be rotated in a horizontal surface about the vertical axis via the lifting jig 4.

(2) Placement a. Stopping of Rotating Operation

When the gimbal 8 is free to rotate during forced rotation of the gimbal 8 (cutting off of the power source and releasing of the clutch), the load 3 tends to continue to rotate due to inertia. By blocking rotation, the inertia force of the flywheel 10 acts on the load to resist rotation of the load to decelerate until finally stopped.

b. When rotation of the rotation shaft 7 is braked by the brake of the gimbal driving motor 11 during forced rotation to lock, the gyro effect becomes inactive. In this case, since the load 3 is in rotation, rotation is continued due to inertia while decelerating until finally stopped.

It should be noted that it is desirable to rotate the gimbal in the condition where the spinning axis of the flywheel 10 is substantially in a horizontal orientation (desirably within 45° in left and right direction). For this purpose, a stopper for restricting rotation so that the gimbal may rotate within this range, may be provided. In the alternative, it is possible to position the rotation shaft 7 at a higher position than the spinning axis so as to maintain the horizontal condition due to its own weight.

Next, discussion will be given for the second embodiment of the method and system for controlling attitude of the lifting load according to the present invention.

Figure 3:
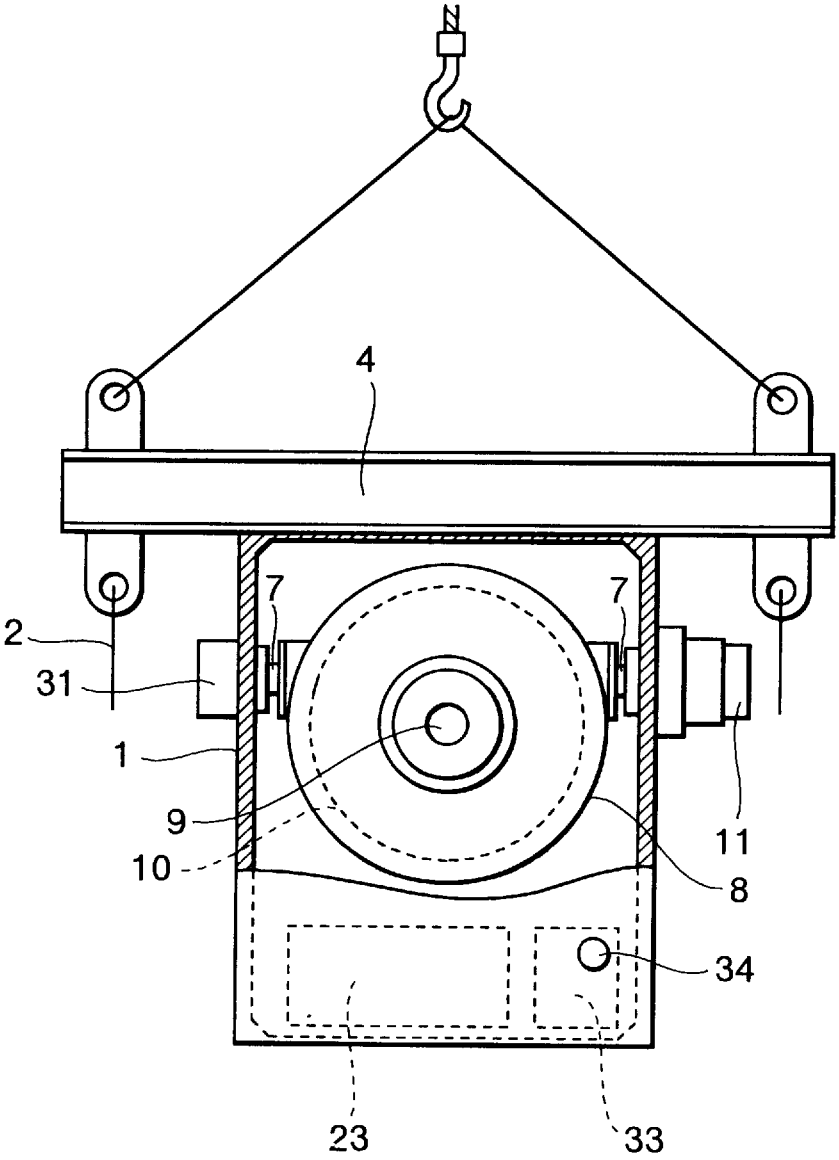
FIG. 3 is a partially sectioned front elevation of a second embodiment of the lifting load attitude controlling system utilizing the gyro effect, according to the invention.
Figure 4:
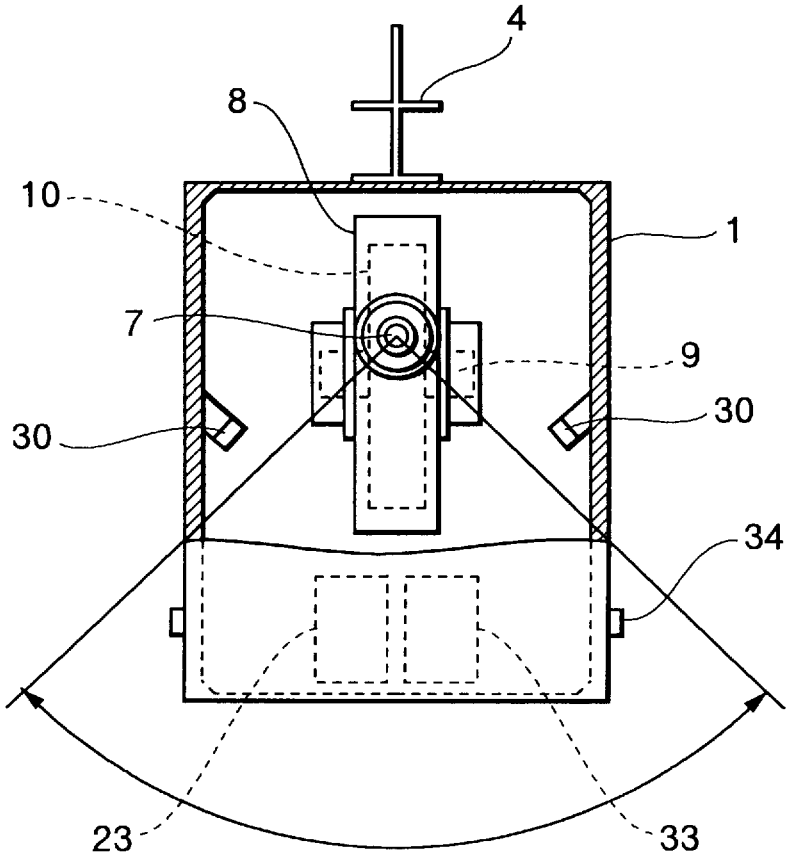
FIG. 4 is a partially sectioned side elevation of the system of FIG. 3.

FIGS. 3 and 4 shows the second embodiment of the method and the system for controlling the attitude of the lifting load. In the illustrated embodiment, the gyro frame 1 is fixed on a lower portion of the lifting jig 4 in a suspended condition. On the other hand, stoppers 30 are provided at inner side portion of the gyro frame 1 for restricting range of rotation of the gimbal 8 as shown in FIG. 4. Furthermore, in order to detect the rotational position of the rotation shaft 7, a rotational position detecting sensor 31 is provided on the outer side of the gyro frame 1. The particular rotational position detecting sensor 31 may include various sensors, such as those combined with an encoder, a potentiometer or limit switch, those combined with a photosensor or so forth.

In the illustrated embodiment, the rotation shaft 7 of the gimbal frame 6 is offset upwardly from a gravity center of the entire gimbal including the flywheel (in the shown embodiment, the spinning axis since the gravity center of the entire gimbal and the spinning axis of the flywheel are consistent to each other).

When the gimbal is made free upon lifting up of the load, if the force causing rotation of the load is exerted by an external disturbance, such as wind or so forth, the gimbal 8 is rotated by the gyro effect. With a pre-session force of the flywheel to be generated at this time, rotation of the load can be restricted so as to permit the load to maintain the attitude before exertion of the external disturbance.

When the external disturbance is gone, or the gimbal is rotated in response to the external disturbance, the spinning axis of the flywheel 10 is oriented at a non-horizontal orientation. However, since the rotation shaft 7 of the gimbal is offset upwardly relative to the spinning axis 9 of the flywheel so as to place the gravity center of the gimbal at a lower position than the rotation shaft 7, the spinning axis 9 is returned into the horizontal orientation due to the weight of the gimbal. Therefore, the rotating force to be generated can be improved at the occurrence of pivoting of the load by forced rotation.

On the other hand, while the gimbal is forcedly rotated for pivoting of the lifting load, the rotation of the gimbal becomes free. When rotation of the load which continues rotating by inertia, is to be stopped, the inertia force of the flywheel 10 acts thereon to gradually decelerate rotation of the load until finally stopped. At this time, the gimbal 8 may rotate in the opposite direction by the restoring force in order to cancel mechanical loss of the speed reduction gear unit, the gimbal driving motor and the brake forming the rotational driving portion of the gimbal.

It should be noted that, in the illustrated embodiment, since the gravity center of the entire gimbal and the spinning axis of the flywheel 10 are consistent, the rotation shaft 7 of the gimbal 8 is located at a position above that of the spinning axis 9. An example of the case where the gravity center of the entire gimbal and the spinning axis are not consistent, is shown in FIGS. 5(*a*) to 5(*c*).

Figure 5A:
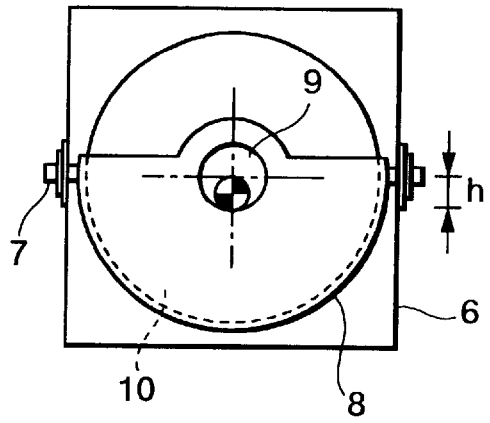
FIGS. 5(*a*)–5(*c*) are perspective views showing a third embodiment of the system for controlling attitude of the lifting load according to the present invention.
Figure 5B:
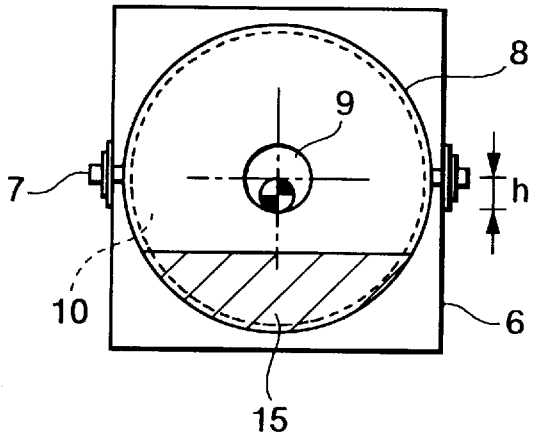
Figure 5C:
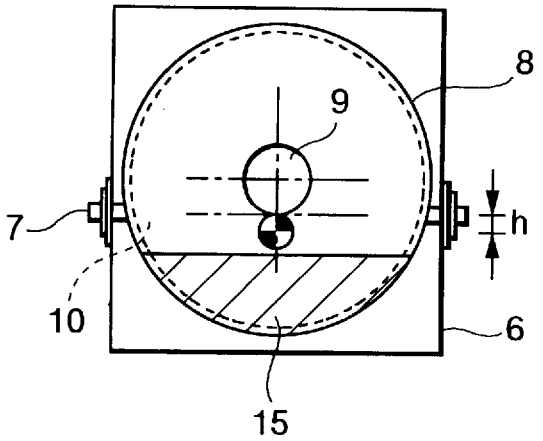
Figure 6A:
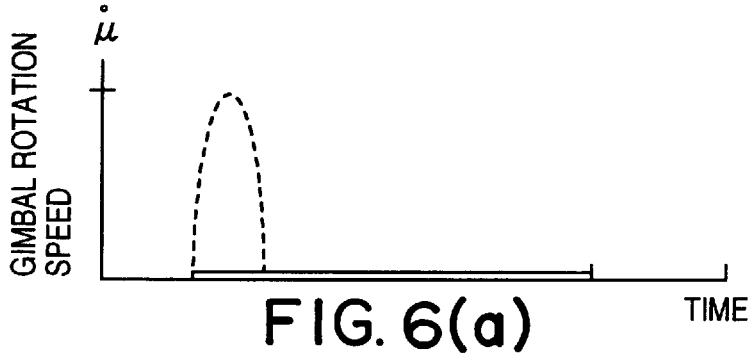
FIGS. 6(*a*)–6(*d*) are graphs comparison between the operation of the illustrated embodiments and the prior art.
Figure 6B:
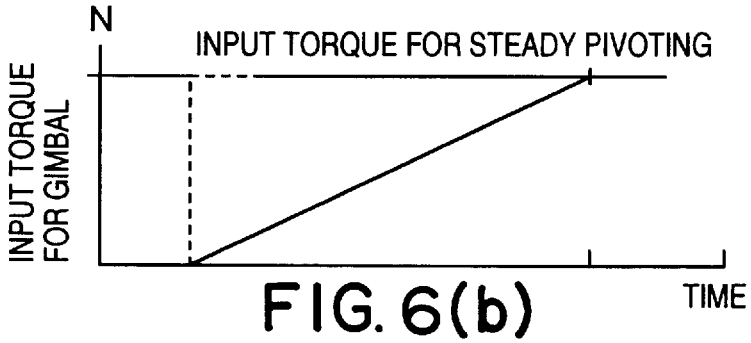
Figure 6C:
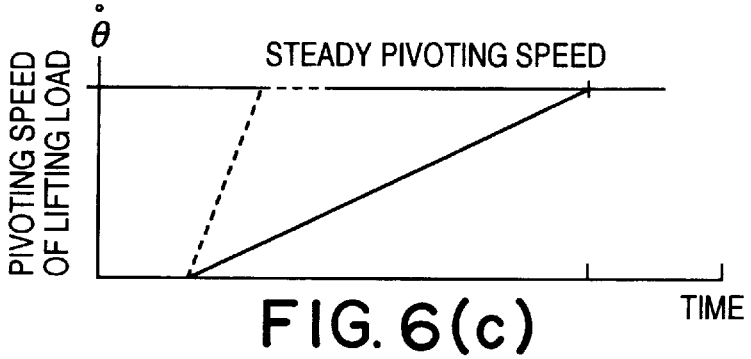
Figure 6D:
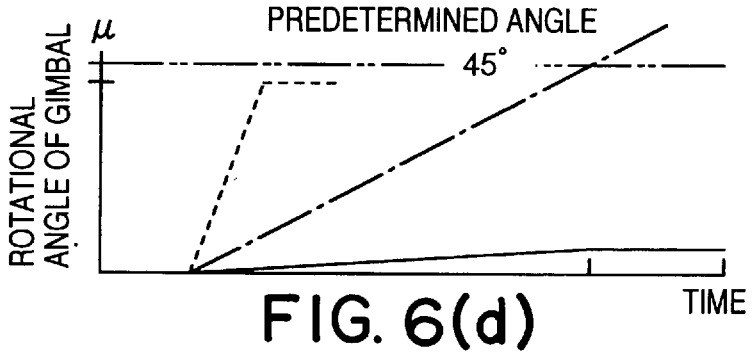

In FIG. 5(*a*), the upper halt of the gimbal 8 is cut-out to expose the upper half of the flywheel 10 in the gyro frame 6. In this example, the gravity center of the entire gimbal including the flywheel 10 is placed at the lower position than the spinning axis 9. As a result, the rotation shaft 7 of the gimbal 8 and the spinning axis 9 can be consistent. In FIG. 5(*b*), while the upper half of the gimbal 8 is not cut-out, and instead, a weight 15 is provided at the lower portion. By this, the gravity center of the entire gimbal is placed at a lower position than the spinning axis 9 to make the rotation shaft 7 of the gimbal 8 and the spinning axis 9 consistent. Also, in the example of FIG. 5(*c*), while the rotation shaft 7 of the gimbal 8 is placed at a lower position than the spinning axis 9, the gravity center of the entire gimbal is located below the rotation shaft 7 due to a weight 25 provided at the lower portion of the gimbal. In any of the examples set forth above, the spinning axis 9 may return to the horizontal position by the weight of the gimbal, and the comparable effect to the former embodiment can be achieved.

On the other hand, in these embodiment, stoppers 30, 30 are located at positions so as to permit rotation of the flywheel only in the predetermined angular range of the spinning axis 9, i.e. 45° to the left and the right from the horizontal axis lying in a vertical plane taking the rotation shaft 7 of the gimbal as coordinate zero (allowable rotational angle is 90°). The tip end portion of the stopper 30 is formed with an elastic body, such as a rubber or so forth, to absorb a shock upon contacting the gimbal. In this case, since the rotation shaft 7 of the gimbal 8 (spinning axis 9 of the flywheel) will never approach to the vertical direction beyond 45° sufficient gyro effect will be constantly obtained.

Here, when rotation is caused in hanging the load 3 thereby overloading beyond the preliminarily set allowable maximum range, the gimbal tends to rotate beyond 45°. However, since the rotational range of the gimbal 8 is restricted by the stoppers 30 and 30, the side portion of the gimbal 8 makes contact with the stopper 30 to make the gyro effect of the gyroscope inactive at that instance. However, since the load 3 is already rotated, rotation is maintained due to inertia. Therefore, even in the overloaded condition, the lifting load can be rotated. In other words, until the gimbal 8 comes into contact with the stopper 30, the horizontal rotating force by the gyro effect can be transmitted to the load.

In the illustrated embodiment, since the rotation shaft 7 of the gimbal 8 is set at a position upwardly offset from the spinning axis 9 of the flywheel 10, the gravity center of the gimbal 8 is located at a lower position than the rotation shaft 7, and therefore the spinning axis 9 can be returned to the horizontal orientation by the weight of the gimbal 8 by cutting off the power supply for the gimbal driving motor 11 and thus making the gimbal free. Therefore, after horizontally pivoting the load 3 in some extent by forced rotation of the gimbal and subsequently contacting the gimbal 8 onto the stopper 30 to allow the load 3 to rotate by inertia, repeating shutting off of the power supply for the gimbal driving motor 11 and returning of the spinning shaft to the horizontal position, and forcedly rotating the gimbal 8 and contacting the stopper 30, the lifting load with the weight in an overloading condition can be rotated continuously while maintaining the attitude thereof.

Here, the conventional method for controlling rotation of the load utilizing the gyro effect will be discussed. Namely, upon pivoting the load 3, as shown by solid line in FIGS. 6(*a*) to 6(*d*), in order to constantly maintain low speed of rotation of the gimbal as shown in FIG. 6(*a*), and for adjusting input torque of the gimbal 8 by detecting the rotation speed of the load 3 and by feeding back the detected rotation speed of the load 3 as shown in FIG. 6(*b*), rotation of the load 3 is gradually accelerated until a steady rotation is reached as shown in FIG. 6(*c*). It should be noted that as a result of control as set forth above, the rotational angle of the gimbal as shown in FIG. 6(*d*) is tilted gradually.

However, it becomes necessary to strictly perform fine adjustment of the input torque of the gimbal. If adjustment causes a slight offset, the rotational angle of the gimbal may cause an abrupt increase of the tilting as shown by one dotted line in FIG. 6(*d*), to cause the spinning shaft 9 of the flywheel, in vertical position, to make the horizontal rotating force zero. If this is the case, it becomes impossible to operate the lifting load 3 for rotation.

Then, as shown in broken line FIG. 6(*b*), when the torque necessary for steady rotation of the lifting load is initially applied, a large rotational force may act on the load 3. In conjunction therewith, abrupt variation of the rotation speed, as shown by broken line in FIG. 6(*a*), is caused in the gimbal. Also, the rotational angle of the gimbal 8 is increased abruptly. Then, the lifting load 3 reaches the steady rotation speed (where equilibrium between the input torque to the gimbal 8 by the gimbal driving motor 11 and rotating torque (reaction torque) of the gimbal by the gyro effect to be caused by horizontal rotating force exerted on the gimbal by rotation of the load, is established) is reached so as to stop rotation of the gimbal 8. If the load 3 is an excessive load, the predetermined angle may be exceeded. However, in the present invention, the possibility of tilting in excess of the predetermined angle can be successfully avoided by the presence of the stoppers 30. Thus, safety of the control method can be achieved.

It should be noted that the rotation shaft 7 of the gimbal frame 6 may be located at a lower position than the gravity center of the entire gimbal 8. In this case, under the free condition where a rotational force is not exerted on the rotation shaft 7 of the gimbal, the gimbal 8 may tilt either toward the left or the right by its weight, by restricting tilting of the gimbal 8, a similar effect can be obtained.

Then, when an external disturbance, such as wind or so forth acts on the lifting load during a lifting operation, the reset position of the gimbal 8 is significantly displaced in the extent corresponding to the external disturbing component, and thus balance is significantly destroyed in rotational performance in a certain rotational direction, the lifting jig 4 or load 3 is placed on the ground or stationary portion of the construction to make it impossible to pivot the load irrespective of the rotation of the gimbal 8. Next, on the basis of the rotational position detected by the gimbal rotational position detecting sensor 31, the gimbal driving motor 11 is driven in a direction requiring a smaller rotational magnitude to the initial position. When the rotational position detecting sensor 31 detects the gimbal 8 reaching the rotational position in the vicinity of the initial position, driving of the motor 11 is stopped to stop rotation of the gimbal 8. At the same time, by locking the gimbal 8, correction of the offset position or resetting of the gimbal can be performed in the condition where the gyro effect is released.

On the other hand, a radio apparatus for transmitting and receiving an operation signal from a remote position is provided within the control unit 23. The operator performs radio operation through an operating radio apparatus in hand while visually observing rotational attitude of the load 3. The operator can be plural and the operating position can be a plurality of separated positions. When a plurality of operating radio apparatuses are employed, it is desirable to set a preference of operation for assuring security.

It should be noted that the reference numeral 33 denotes a power source unit, in which a power source battery and a battery charger are provided. When a power source is supplied externally, a power source converter may be provided.

Figure 7:
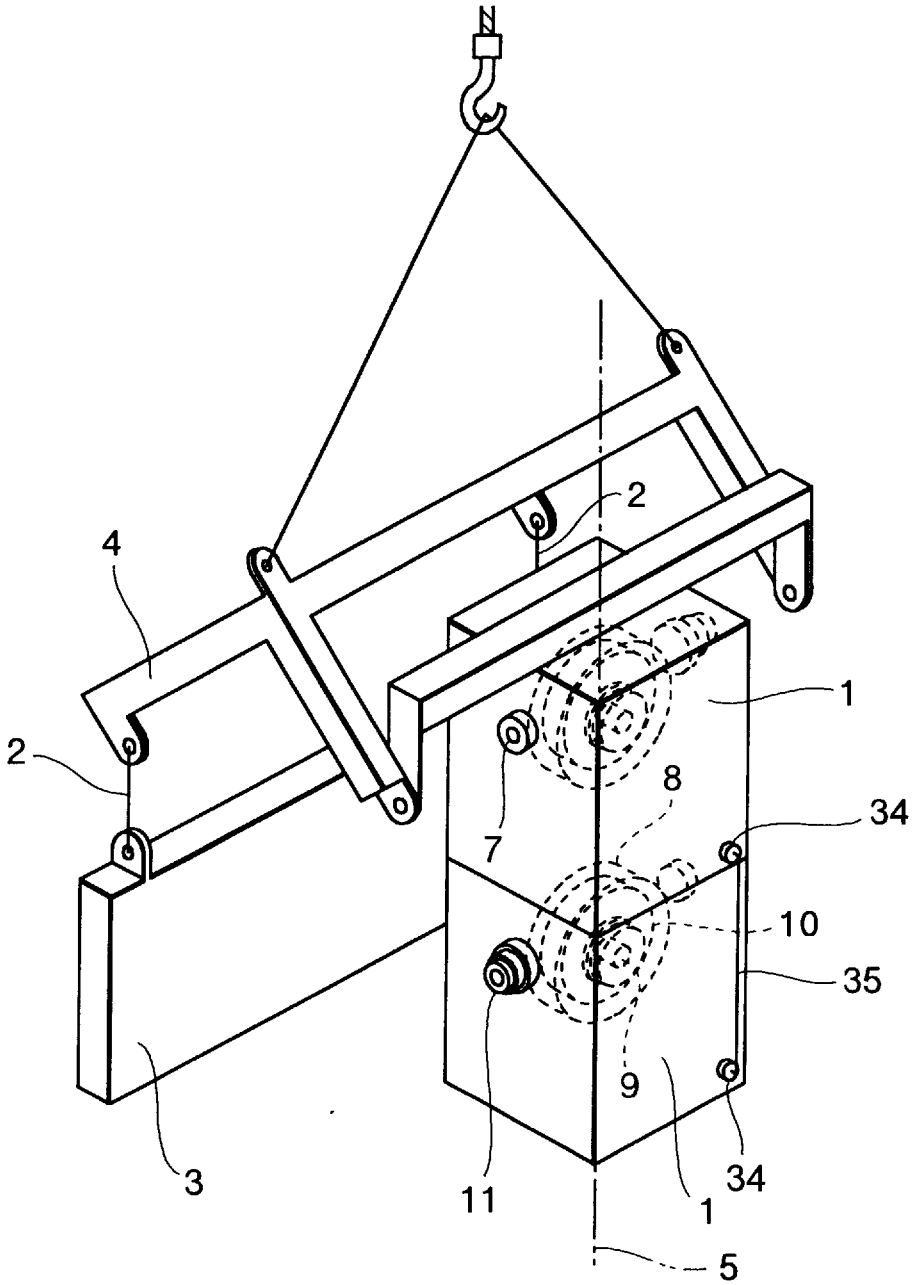
FIG. 7 is a perspective view showing a fourth embodiment of the lifting load attitude control system employing a gyro effect, according to the present invention.

FIG. 7 shows the third embodiment of the method and system for controlling attitude of the load according to the present invention. In the illustrated embodiment, a plurality of rotation control systems are employed for one load 3. Then, any one of the radio apparatuses is taken as a master. Also, a cable connector 34 is provided for making the signal thereof in common with other radio apparatus. By connecting a plurality of rotation control systems by a cable 35 via the cable connectors 34, respective rotation control apparatuses can be synchronized with each other. It should be noted that the gyro frame 1 is fixed on the lifting jig so that the weight of the load 3 and the weight of the lifting equipment will not be exerted directly on the gyro frame 1.

As shown in FIG. 7, when a plurality of rotating systems are arranged along a direction of the rotation shaft (vertical direction), rotational vector axis for rotation can be placed coaxially, or quite close to the common axis. Therefore, rotational force doubling or tripling of gyro effect can be obtained depending upon the efficiency and number of the rotating systems. When a plurality of rotating systems are provided, they may be placed at upper and lower sides of the lifting jig 4.

Figure 8:
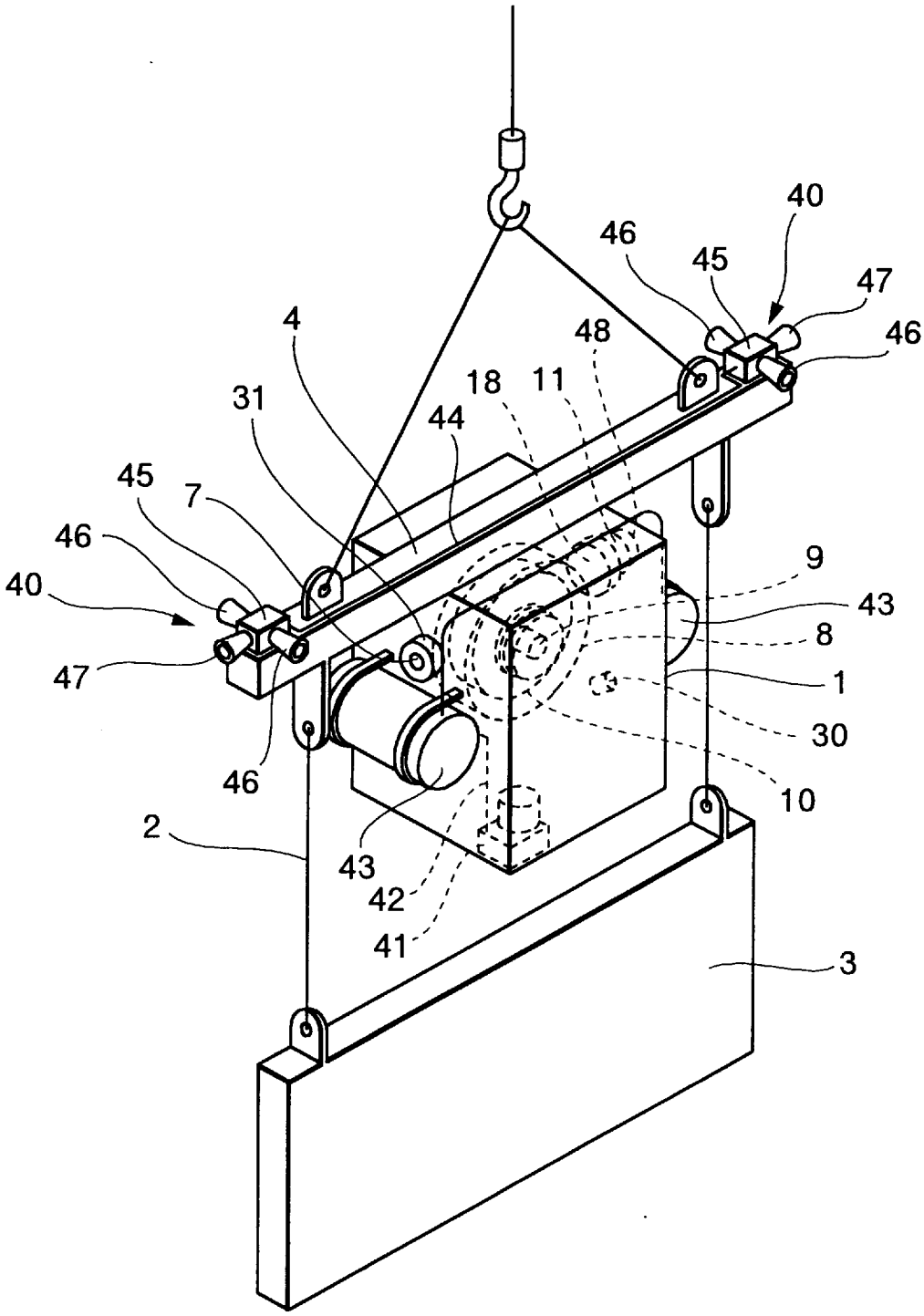
FIG. 8 is a perspective view showing a fifth embodiment of the lifting load attitude control system employing a gyro effect, according to the present invention.

FIG. 8 shows the fourth embodiment of the lifting load attitude control system, which employs a gyro effect, according to the present invention. In the illustrated embodiment, an air ejection means 40 are provided at both ends of a lifting jig 4. By creating a reacting force with the ejection of air from the air ejection means 40, the gimbal 8, displaced from the offset position, is returned to the initial position.

In the inner bottom portion of the gyro frame 1, an air compressor 41 is provided. Compressed air, generated by the air compressor 41, is accumulated in a cylindrical air receiver tank 43 provided at the outer portion of the gyro frame 1 via a first flexible hose 42. To the air receiver tank 43, one end of a second flexible hose 44 is connected. The other end of the second flexible hose 44 is connected to respective air ejection means 44.

Each of the air ejection means 40 is provided with an electromagnetic opening and closing valve 45 which is connected to the second flexible hose 44. In the electromagnetic opening and closing valve 45, an air ejection nozzle 46 extending in horizontal direction perpendicular to longitudinal direction of the lifting jig 4, and an air ejection nozzle 47 extending in horizontally outside and along the longitudinal direction of the lifting jig 4 are connected. Then, by selectively opening and closing the electromagnetic opening and closing valve 45, the compressed air is selectively ejected from respective nozzles 46 and 47.

As viewing the lifting jig 4 from the upper side, the nozzle 46 ejects air forward in a tangent direction of a horizontal circle having a diameter of the lifting jig 4. By selectively ejecting air from the air ejecting means 40, the lifting jig 4 is rotated in the direction opposite to the air ejecting direction, or in the alternative, is shifted in parallel in the direction perpendicular to the longitudinal direction of the lifting jig. Furthermore, by arbitrarily combining nozzles 46 and 47 to eject air, the lifting jig 4 can be shifted in the direction toward which a composite propelling force by reaction of air ejection is directed.

It should be noted that the air ejection means 40 is arranged at the same distance from the rotational axis in the lifting jig, in order to cause the foregoing effect.

Here, the electromagnetic opening and closing valve 45 is provided for opening and closing the valve provided at a position quite close to the nozzle, and it is desirable to intermittently eject air from the nozzles 46 and 47 by opening and closing the valve in a short cycle. This is because influence of the pressure loss at the intermediate position of the pressurized air supply path (particularly to the second flexible hose 44) is little and thus high pressure and high speed air ejection can be obtained.

On the other hand, in the illustrated embodiment, the rotational position detecting sensor 30 for detecting a rotational position of the gimbal is provided similarly to the second embodiment. In addition, a brake device 48 for braking rotation of the rotation shaft 7 of the gimbal is provided outside of the gyro frame 1, and a free rotation control device 48 for electrically controlling free rotation of the rotation shaft 7 is provided. The free rotation control device 48 is a known device for preventing the rotation shaft 7 from rotating in the forward or reverse directions or for preventing the rotation shaft 7 from rotating in any of the forward and reverse directions for disabling free rotation.

When the load 3 is subject to an external disturbance, such as wind or so forth, during a lifting operation, and thus the gimbal is significantly displaced from the offset position to the extent corresponding to the magnitude of the absorbed external disturbance, or upon re-starting, the gimbal is returned to the initial position in the following manner.

Initialization Without Hanging Lifting Load

At first, after placing the gimbal in a state for free rotation, on the basis of the rotational position detected by the gimbal rotational position detecting sensor 30, air is ejected from respective nozzles 46 located at both ends of the lifting jig 4 to cause rotation of the gimbal 8 toward the initial position. Then, a force couple for causing rotation of the lifting jig is generated to cause rotation of the gimbal by gyro effect. At a timing where the rotational position detecting sensor 30 detects the rotational position of the gimbal 8 reaching in the vicinity of the initial position, air ejection is terminated to stop rotation of the gimbal. At this time, if the air ejection is in a pulse form, rotation is instantly stopped to quickly reset without actuating the brake device. Thus, without fixing the lifting jig 4 or the load 3 on the ground as in the former embodiment, correction of the offset position or resetting to the initial position of the gimbal can be performed in the condition where the gyro effect is released.

Initialization With Hanging Lifting Load

When the rotational force by ejection of air from the nozzles 46 is applied to the lifting jig 3, as set forth above under the condition where the lifting load is hanged, the inertia force of the lifting load and spring function of the hanging rope disposed between the lifting jig 4 and the load 3, it is possible to cause simple harmonic motion with a phase difference between the lifting jig 4 and the load 3. At this time, by restricting the rotational direction in one direction by the gyro effect by the free rotation control device 48, the gimbal 8 can be rotated to the initial position, intermittently. It should be noted that the free rotation control device 48 is applicable in the case where the gimbal 8 is returned to the initial position under the condition where the lifting load is not hanged.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above but to include all possible embodiments which can be embodied within a scope encompassed and equivalents thereof with respect to the features set out in the appended claims.

For instance, it is not essential to position the gyro frame 1 at the center portion of the entire lifting load or the bottom of the lifting jig 4, and it may be provided at the upper portion of the lifting jig 4 or at the end thereof. When the gyro frame 1 is located at the end of the lifting jig 4, it may also be utilized as auxiliary device for the load attitude control system utilizing a fan, for example. When rotating the load utilizing the attitude control system with the fan, it may be considered that the rotating direction of the fan can be reversed to generate a propelling force in the opposite direction. However, similar to stopping of spinning of the flywheel, it is not possible to perform a sequence of operation of high speed rotation in forward direction, stopping rotation and high speed rotation in reverse direction, at high speed. Therefore, by utilizing the control system of the present invention as an auxiliary device, abrupt stopping of rotation can be realized.

What is claimed is:

1. A load attitude control system utilizing a gyro effect, said control system comprising:

a lifting jig suspended in a horizontal attitude for supporting a load;

a gyro frame fixed to said lifting jig;

a gimbal frame supported in said gyro frame;

a gimbal supported in said gimbal frame by a horizontal rotation shaft having a central longitudinal axis;

a flywheel capable of spinning, with respect to said gimbal, about a spinning shaft which is perpendicular to a surface which includes said central longitudinal axis of said rotation shaft;

a rotational driving portion, mounted on said gimbal frame, for driving said gimbal in a forward direction and a reverse direction;

a spinning driving portion, mounted on said gimbal, for spinning said flywheel;

a lifting load pivoting clutch for making said gyro frame and said gimbal frame releasable; and a mechanism for canceling a reaction torque exerted on said rotational driving portion from said gimbal frame.

2. The lifting load attitude control system as claimed in claim 1, further comprising:

a resetting rotation driving portion for obliquely rotating said gimbal upon returning said gimbal to an initial position;

a worm gear mechanism connected to said resetting rotation driving portion;

a resetting rotating clutch provided between said worm gear mechanism and said gimbal or said rotational driving portion and making them releasable; and control means for controlling rotation of the load supported by said lifting jig by controlling driving of said spinning driving portion, said rotational driving portion, and engagement and disengagement of said lifting load pivoting clutch and said resetting rotating clutch.

3. The lifting load attitude control system as claimed in claim 2, further comprising a variable constant torque transmitting device provided between said gyro frame and said gimbal frame.

4. A method for controlling pivoting motion of a load suspended from a lifting jig employing a lifting load attitude control system as claimed in claim 3, said method comprising:

placing said lifting load pivoting clutch in an engaged condition;

placing said resetting rotating clutch in a disengaged position;

driving said spinning driving portion and said rotational driving portion during normal rotating operation; and placing said resetting obliquely rotating clutch in an engaged condition;

placing said lifting load pivoting clutch in a disengaged position; and driving said resetting rotation driving portion upon returning said gimbal to the initial position.

5. A method for controlling pivoting motion of a load suspended from a lifting jig employing a lifting load attitude control system as claimed in claim 2, said method comprising:

placing said lifting load pivoting clutch in an engaged condition;

placing said resetting rotating clutch in a disengaged position;

driving said spinning driving portion and said rotational driving portion during normal rotating operation; and placing said resetting obliquely rotating clutch in an engaged condition;

placing said lifting load pivoting clutch in a disengaged position; and driving said resetting rotation driving portion upon returning said gimbal to the initial position.

6. The lifting load attitude control system as claimed in claim 1, further comprising a variable constant torque transmitting device provided between said gyro frame and said gimbal frame.

7. A method for controlling pivoting motion of a load suspended from a lifting jig employing a lifting load attitude control system as claimed in claim 1, said method comprising:

placing said lifting load pivoting clutch in an engaged condition;

placing said resetting rotating clutch in a disengaged position;

driving said spinning driving portion and said rotational driving portion during normal rotating operation; and placing said resetting obliquely rotating clutch in an engaged condition;

placing said lifting load pivoting clutch in a disengaged position; and driving said resetting rotation driving portion upon returning said gimbal to the initial position.

8. A lifting load attitude control system utilizing a gyro effect, said lifting load attitude control system comprising:

a lifting jig for supporting a load, said lifting jig being disposed in a horizontal attitude;

a gyro frame fixed to said lifting jig;

a gimbal frame supported in said gyro frame;

a gimbal supported in said gimbal frame by a horizontal rotation shaft having a central longitudinal axis;

a flywheel capable of spinning, with respect to said gimbal, about a spinning shaft oriented perpendicular to a surface including said central longitudinal axis of said rotation shaft;

a rotational driving portion mounted on said gimbal frame for driving said gimbal in a forward direction and in a reverse direction;

a spinning driving portion, mounted on said gimbal, for spinning said flywheel;

a rotational position detecting sensor for detecting a rotational position of said gimbal, said rotational driving portion controlling rotation of said gimbal from a rotational position toward an initial position on the basis of an output of said rotational position detecting sensor; and braking means for stopping said rotational driving portion when the rotational position of said gimbal substantially coincides with the initial position.

9. A method for controlling resetting of a gimbal employing a lifting load attitude control system utilizing a gyro effect as claimed in claim 8, said method comprising:

fixing said lifting jig or the load on a stationary portion in order to prohibit said lifting jig or the load from rotating irrespective of forced rotation of said gimbal; and subsequently rotating said gimbal by said rotational driving portion for returning to the initial position of said gimbal.

10. A lifting load attitude control system utilizing a gyro effect, said lifting load attitude control system comprising:

a lifting jig for supporting a load, said lifting jig being disposed in a horizontal attitude;

a gyro frame fixed to said lifting jig;

a gimbal frame supported in said gyro frame;

a gimbal supported in said gimbal frame by a horizontal rotation shaft having a central longitudinal axis;

a flywheel capable of spinning, with respect to said gimbal, about a spinning shaft oriented perpendicular to a surface including said central longitudinal axis of said rotation shaft;

a rotational driving portion, mounted on said gimbal frame, for driving said gimbal in a forward direction and in a reverse direction;

a spinning driving portion, mounted on said gimbal, for spinning said flywheel;

a rotational position detecting sensor for detecting a rotational position of said gimbal;

air ejecting means for generating a moment about a rotation shaft on said lifting jig for rotating said lifting jig from a rotational position of said gimbal to an initial position by reaction forces provided by air ejection from said air ejecting means on the basis of an output of said rotational position detecting sensor; and braking means for stopping said rotational driving portion when the rotational position of said gimbal substantially coincides with the initial position of said gimbal.

11. The lifting load attitude control system as claimed in claim 10, wherein said air ejecting means ejects air in a pulsed form.

12. The lifting load attitude control system as claimed in claim 10, wherein a free rotation direction controller is provided on said rotation shaft of said gimbal.

13. A lifting load attitude control system utilizing a gyro effect, said lifting load attitude control system comprising:

a lifting jig for supporting a load, said lifting jig being disposed in a horizontal attitude;

a gyro frame fixed to said lifting jig;

a gimbal frame supported in said gyro frame;

a gimbal supported in said gimbal frame by a horizontal rotation shaft having a central longitudinal axis;

a flywheel capable of spinning, with respect to said gimbal, about a spinning shaft oriented perpendicular to a surface which includes said central longitudinal axis of said rotation shaft;

a rotational driving portion, mounted on said gimbal frame, for driving said gimbal in a forward direction and in a reverse direction; and a spinning driving portion, mounted on said gimbal, for spinning said flywheel, wherein said rotation shaft of said gimbal is located above a gravity center of said gimbal including said flywheel.

14. A lifting load attitude control system utilizing a gyro effect, said lifting load attitude control system comprising:

a lifting jig for supporting a load, said lifting jig being disposed in a horizontal attitude;

a gyro frame fixed to said lifting jig;

a gimbal frame supported in said gyro frame;

a gimbal supported in said gimbal frame by a horizontal rotation shaft having a central longitudinal axis;

a flywheel capable of spinning, with respect to said gimbal, about a spinning shaft oriented perpendicular to a surface which includes the central longitudinal axis of said rotation shaft;

a rotational driving portion, mounted on said gimbal frame, for driving said gimbal in a forward direction and in a reverse direction;

a spinning driving portion, mounted on said gimbal, for spinning said flywheel; and stoppers for restricting rotation of said gimbal to within, a predetermined angular range of the spinning axis of said flywheel from a horizontal axis in a vertical plane taking said rotation shaft as a zero coordinate.

15. The lifting load attitude control system as claimed in claim 14, wherein said predetermined angle is an angle of said gimbal when equilibrium between an input torque by a rotation motor rotating said gimbal and a reaction torque generated in the rotation shaft of said gimbal frame upon pivoting the load with a designed allowable maximum load at a steady pivoting speed or an angle which is slightly greater than said angle of said gimbal.

16. The lifting load attitude control system as claimed in claim 14, wherein said rotation shaft of said gimbal is set at a position below said spinning shaft and above a gravity center of said gimbal including said flywheel.

17. A control method employing a lifting load attitude control system utilizing a gyro effect, said control system including:

a lifting jig for suspending a load, said lifting jig being disposed in a horizontal attitude;

a gyro frame fixed to said lifting jig;

a gimbal frame supported in said gyro frame;

a gimbal supported in said gimbal frame by a horizontal rotation shaft having a central longitudinal axis;

a flywheel capable of spinning, with respect to said gimbal, about a spinning shaft oriented perpendicular to a surface which includes said central longitudinal axis of said rotation shaft;

a rotational driving portion, mounted on said gimbal frame, for driving said gimbal in a forward direction and in a reverse direction;

a spinning driving portion, mounted on said gimbal, for spinning said flywheel;

a braking mechanism, connected between said gyro frame and said gimbal frame, for effecting braking of rotation of said gimbal; and control means for pivoting the load suspended from said lifting jig by controlling driving of said rotation driving portion, said spinning driving portion and said braking mechanism, wherein said control method comprises stopping rotation of said gimbal by said braking mechanism or locking said gimbal during high speed rotation of said flywheel by driving said spinning driving portion.

18. The control method as claimed in claim 17, wherein pivoting of the load due to inertia of the load and an external disturbance by making the gimbal free during high speed rotation of said flywheel by driving by said spinning driving portion.

* * * * *